US006155809A

United States Patent [19]

Edwards et al.

[11] Patent Number: 6,155,809

[45] Date of Patent: Dec. 5, 2000

[54] APPARATUS FOR APPLYING VISCOUS MASS TO A SURFACE CORNER

[75] Inventors: Toby Edwards, Phoenix; Jeff Mowry, Mesa; David F. Kreitzer, Phoenix, all of Ariz.

[73] Assignee: Equity Earnings Corp DBA Designer Products, Phoenix, Ariz.

[21] Appl. No.: 09/238,389

[22] Filed: Jan. 27, 1999

[51] Int. Cl.[7] ..... B05C 17/10

[52] U.S. Cl. ..... 425/87; 15/235.7; 15/235.8; 425/458

[58] Field of Search ..... 425/87, 458; 15/235.4, 15/235.7, 235.8

[56] References Cited

U.S. PATENT DOCUMENTS

| | | | |
|---|---|---|---|
| 2,824,443 | 2/1958 | Ames | 425/87 |
| 3,932,101 | 1/1976 | Johnson et al. | 425/458 |
| 4,116,604 | 9/1978 | Johnson et al. | 425/87 |
| 4,451,223 | 5/1984 | Mower et al. | 425/458 |
| 4,767,297 | 8/1988 | Mower et al. | 425/87 |
| 5,010,618 | 4/1991 | Croft | 425/87 |
| 5,263,836 | 11/1993 | Tinawong | 425/87 |
| 5,423,666 | 6/1995 | MacMillan | 425/87 |
| 5,622,729 | 4/1997 | Mower | 425/87 |

*Primary Examiner*—Robert Davis
*Attorney, Agent, or Firm*—Parsons & Goltry; Robert A. Parsons; Michael W. Goltry

[57] ABSTRACT

An applicator head for receiving and distributing viscous mass to a surface corner comprising a chassis engagable with a source of viscous mass and a trowel assembly carried by the chassis for receiving viscous mass from the chassis and distributing the viscous mass against a surface corner, the trowel assembly comprising an angularly flexible housing and elongate blades carried by the angularly flexible housing for movement in pivotal and reciprocal directions in response to angular flexing of the angularly flexible body.

30 Claims, 9 Drawing Sheets

APPARATUS FOR APPLYING VISCOUS MASS TO A SURFACE CORNER

FIELD OF THE INVENTION

This invention relates generally to the field of apparatus for distributing viscous mass to a surface and, more particularly, to apparatus for distributing viscous mass to a surface corner.

BACKGROUND OF THE INVENTION

Drywall installation is a customary procedure in building construction. Once drywall is installed, it is necessary to seal the joints separating adjacent sections of drywall. This sealing operation normally involves applying courses of tape to cover the joints followed by the application of mastic or other similar adhesive-type viscous mass to cover the tape. Because the application of mastic to tape at surface corners proves particularly challenging, skilled artisans have devoted considerable effort toward apparatus for distributing mastic along surface corners. Although exemplary, known such apparatus suffer from structural shortcomings that inhibit easy and efficient use, thus necessitating certain new and useful improvements.

Accordingly, it would be highly desirable to provide new and improved apparatus for distributing viscous mass to a surface corner.

It is a purpose of the present invention to provide new and improved apparatus for distributing viscous mass to a surface corner that is easy to use.

It is another purpose of the present invention to provide new and improved apparatus for distributing viscous mass to a surface corner that is easy to construct.

It is still another purpose of the present invention to provide new and improved apparatus for distributing viscous mass to a surface corner that is inexpensive.

It is a further purpose of the present invention to provide new and improved apparatus for distributing viscous mass to a surface corner that incorporates an angularly flexible housing for accommodating surface corners of varying angularity.

It is still a further purpose of the present invention to provide new and improved apparatus for distributing viscous mass to a surface corner that incorporates an angularly flexible housing for accommodating surface corners of varying angularity, and that supports blades for doctoring the viscous mass during distribution that move in response to angular flexing of the angular flexible housing.

It is yet still a further purpose of the present invention to inhibit the frustration normally experienced by tradesmen when installing adhesive-type viscous mass to surface corners with conventional apparatus.

SUMMARY OF THE INVENTION

The above problems and others are at least partially solved and the above purposes and others realized in new and improved apparatus for distributing viscous mass to a surface corner. In a preferred embodiment, the invention comprises an applicator head including a chassis coupled with a source of viscous mass. A trowel assembly is carried by the chassis for receiving viscous mass from the chassis and evenly distributing the viscous mass against a surface corner. The trowel assembly comprises a housing carried by the chassis for angular flexing movement between a normal first angular orientation and a second angular orientation.

The housing carries first and second elongate blades in angularly converging relation for movement in pivotal and reciprocal directions in response to angular flexing of the angularly flexible housing.

BRIEF DESCRIPTION OF THE DRAWINGS

The foregoing and further and more specific objects and advantages of the instant invention will become readily apparent to those skilled in the art from the following detailed description thereof taken in conjunction with the drawings in which.

DETAILED DESCRIPTION OF PREFERRED EMBODIMENTS

The present invention provides, among other things, new and improved apparatus for distributing mastic or other similar adhesive-type viscous mass to a surface corner. Ensuing embodiments of the present invention are easy to use and construct, and prove exemplary for the easy and efficient distribution of viscous mass to surface corners of varying angularity.

Figure 1:
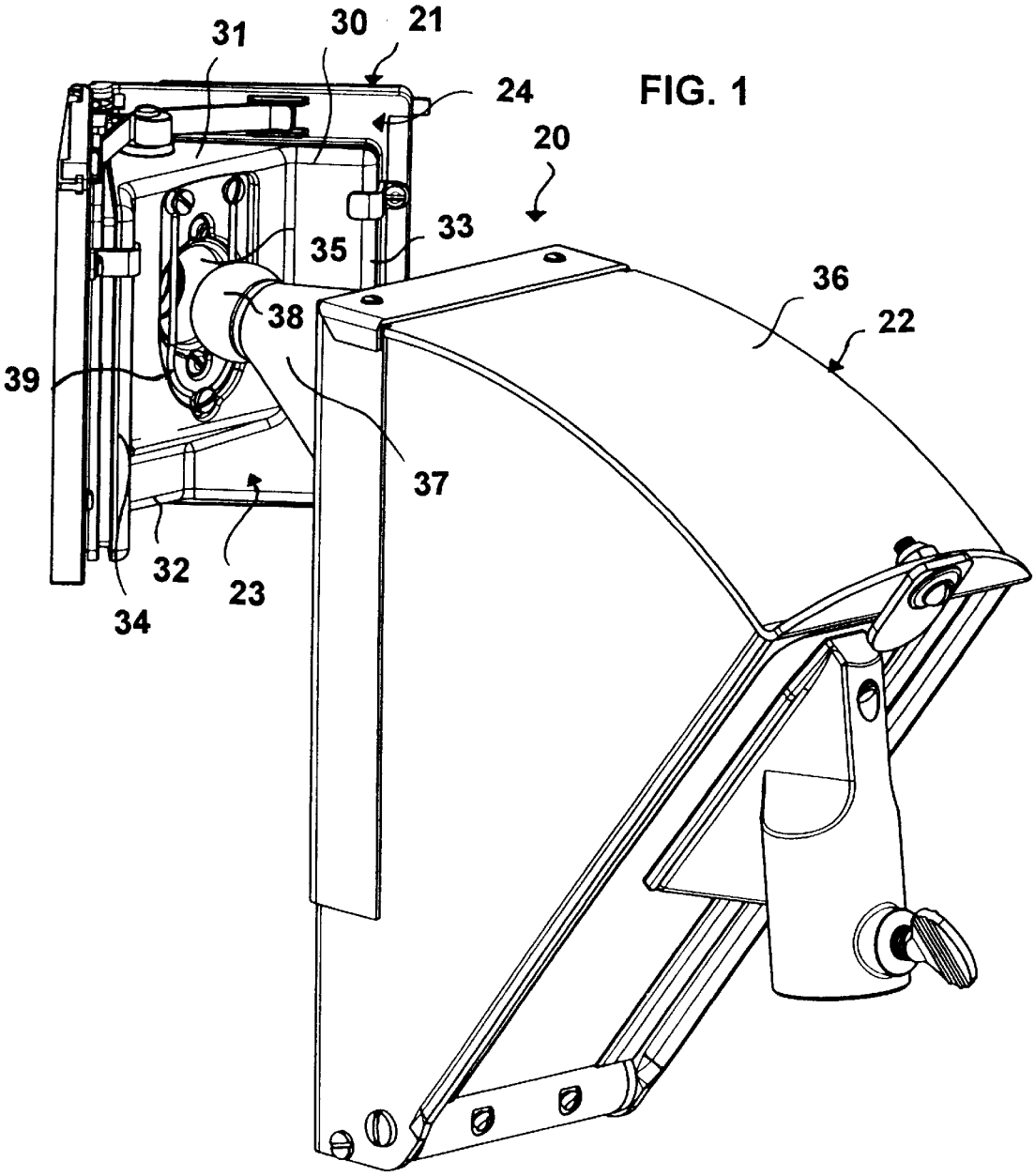
FIG. 1 is an isometric view of apparatus for distributing viscous mass to a surface corner, the apparatus including an applicator head for receiving viscous mass from a source and distributing the viscous mass to a surface corner.
Figure 2:
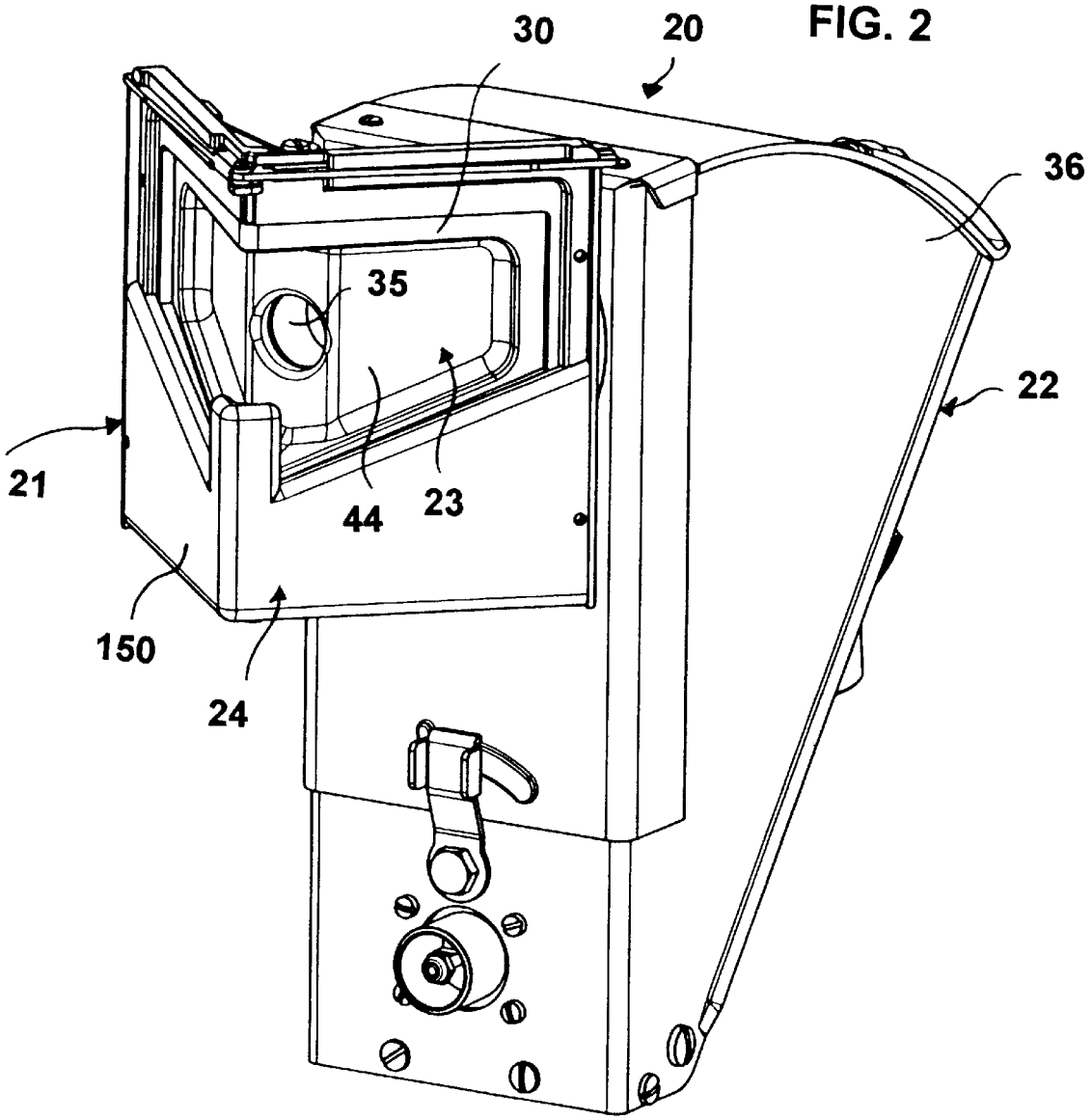
FIG. 2 is another isometric view of the apparatus of FIG. 1.

Turning now to the drawings, in which like reference characters indicate corresponding elements throughout the several views, attention is first directed to FIGS. 1 and 2 which illustrate isometric views of apparatus 20 for distributing viscous mass to a surface corner. Apparatus 20 includes an applicator head 21 for receiving viscous mass from a source 22 and distributing the viscous mass to a surface corner as it is drawn along the surface corner. Applicator head 21 is generally comprised of a chassis 23 engagable with source 22 for receiving viscous mass, and a trowel assembly 24 carried by chassis 23 for receiving viscous mass from chassis 23 and distributing the viscous mass against a surface corner as it is drawn along the surface corner. Trowel assembly 24 is engagable with the convergent walls of a surface corner to which mastic or other suitable adhesive-type viscous mass is being applied.

Figure 5:
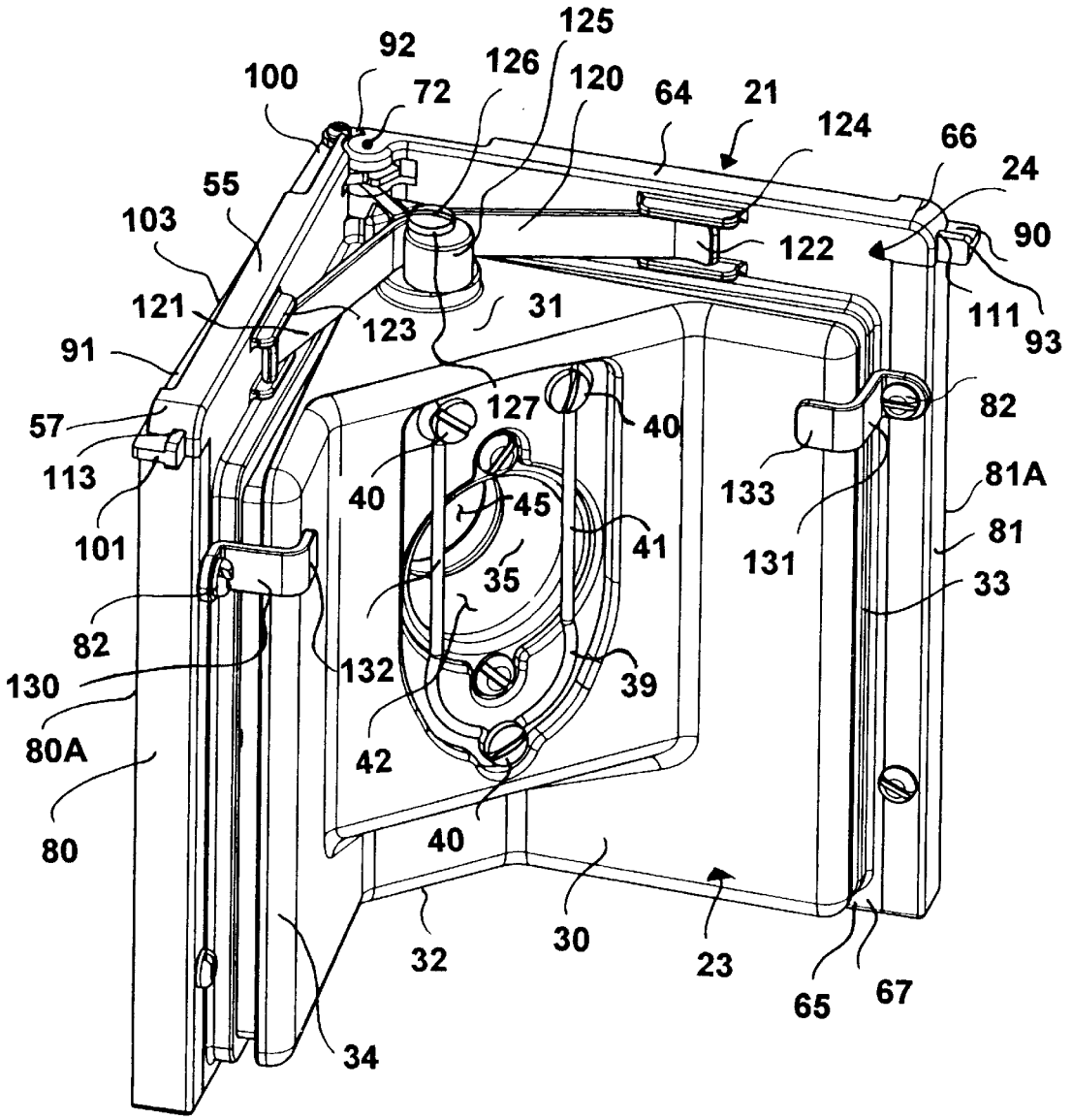
FIG. 5 is yet another isometric view of the applicator head of FIG. 3.
Figure 8:
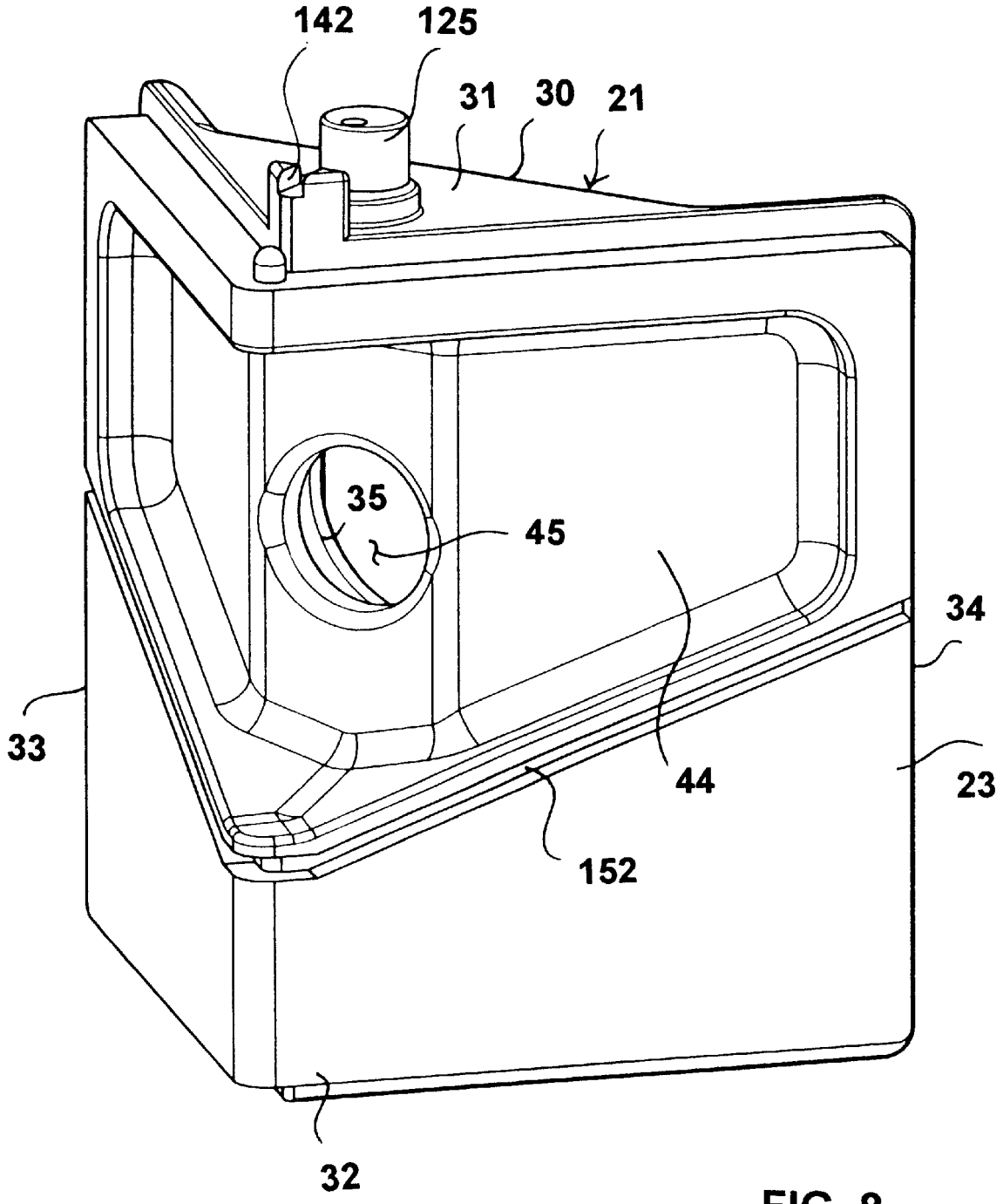
FIG. 8 is an isometric view of the chassis of the applicator head of FIG. 3.

Turning to FIG. 8, chassis 23 comprises a body 30 constructed of cast aluminum, ceramic or other substantially rigid material. Body 30 defines two convergent and substantially perpendicular planes, and may be integrally formed if desired. Body 30 supports trowel assembly 24 and includes an upper end 31, a lower end 32 and first and second lateral extremities 33 and 34. Body 30 supports a conventional socket 35 provided for receiving viscous mass much like conventional corner finishing tools replete in the art. In this regard, and with attention directed momentarily back to FIG. 1, source 22 includes a vessel 36 having a nozzle 37 for expelling viscous mass contained by vessel 36. Nozzle 37 terminates with an enlarged, spherical tip 38 sized for receipt by socket 35. A spring 39 is fastened to the backside of body 30 with screws 40 and includes elongated portions 41 that traverse either side of the rearward opening 42 leading to socket 35 as shown in FIG. 5. Spring 39 is preferably constructed of a selected metal having shape memory and serves to hold tip 38 in socket 35, and to inhibit tip 38 from unintentionally dislodging from socket 35. Spring 39 is sufficiently flexible to permit tip 38 to be inserted into, and removed from, socket 35.

Looking back to FIG. 8, body 30 further includes a recess or pocket 44 that is open in two convergent and substantially perpendicular planes as defined by body 30. Recess 44 communicates with a forward opening 45 leading to socket 35, and is operative for collecting viscous mass for transfer to trowel assembly 24.

Figure 3:
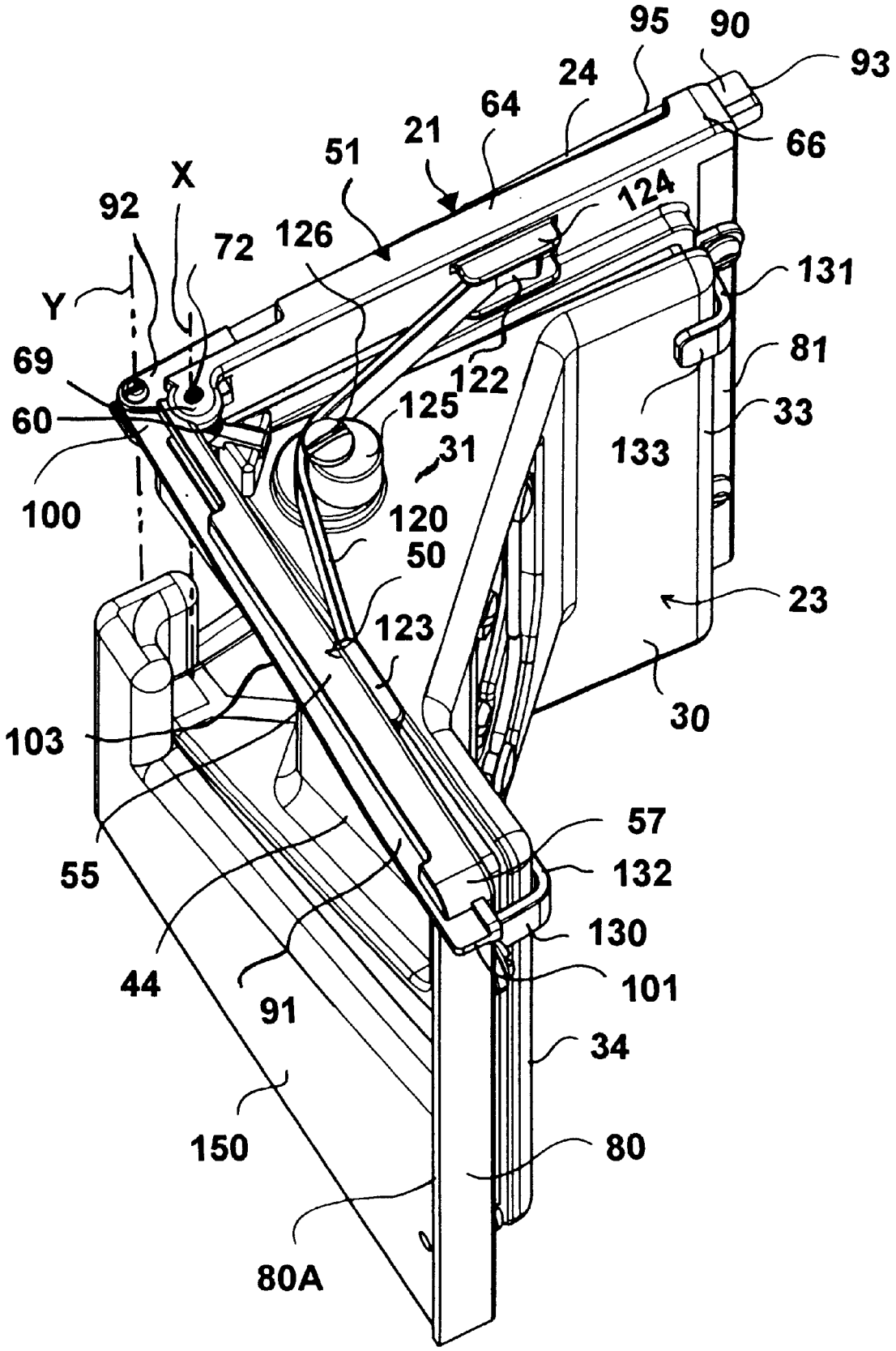
FIG. 3 is an isometric view of the applicator head of FIG. 1, the applicator head including a chassis and a housing carried by the chassis for angularly flexing movement.
Figure 4:
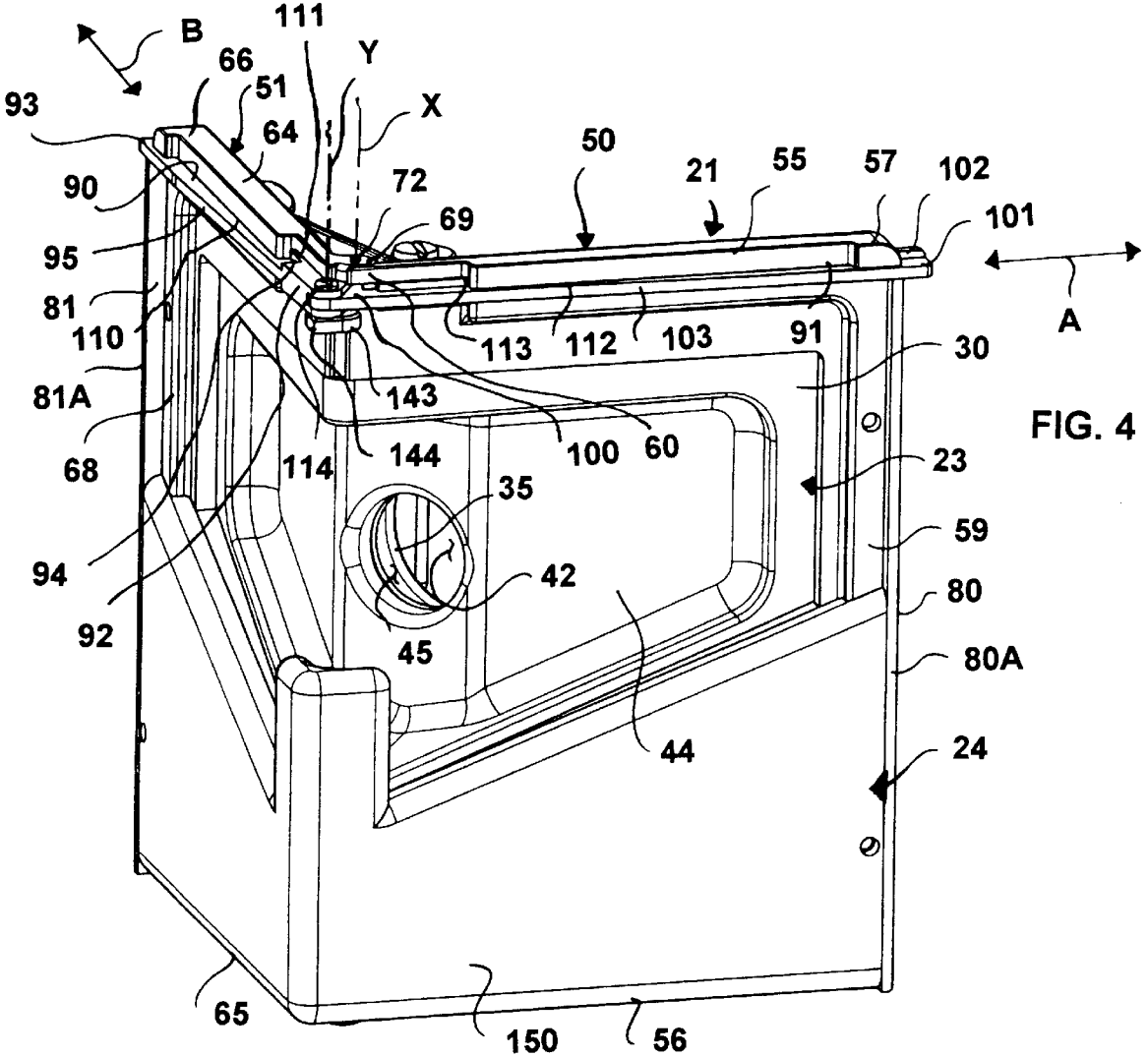
FIG. 4 is another isometric view of the applicator head of FIG. 3.
Figure 9:
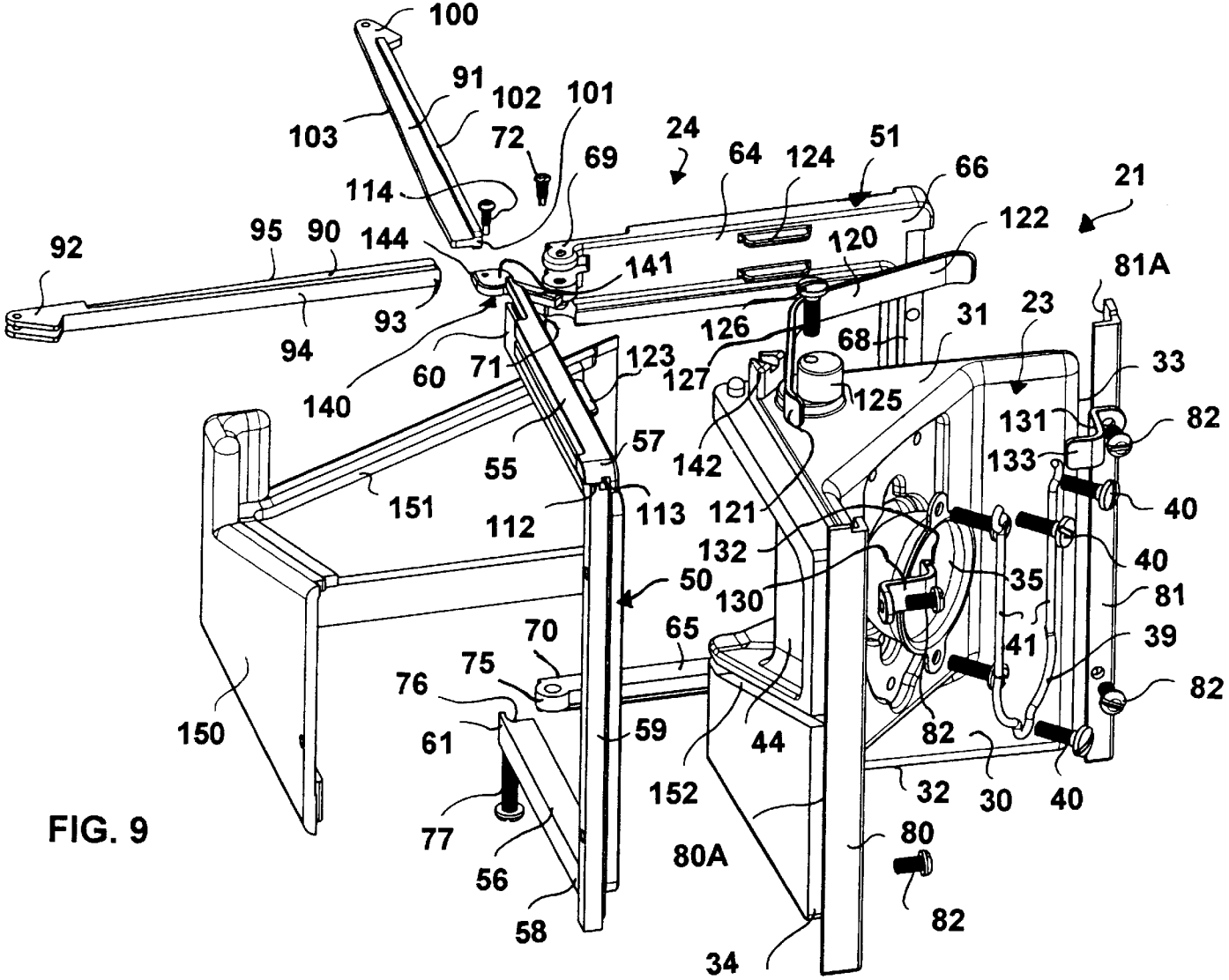
FIG. 9 is an exploded isometric view of the applicator head of FIG. 3.

Turning to FIGS. 3 and 4, trowel assembly 24 includes a housing engagable so as to be supported by chassis 23 for angular flexing or pivotal movement. The housing, details of which are best illustrated in FIG. 9, includes first and second frameworks 50 and 51 engagable together for angular flexing movement. First framework 50 is substantially U-shaped and includes first and second arms 55 and 56 interconnected at their proximal ends 57 and 58 with a transom 59. First and second arms 55 and 56 each terminate with a free end 60 and 61, respectively, and are disposed in spaced apart and substantially parallel relation. Like first framework 50, second framework 51 is substantially U-shaped and includes first and second arms 64 and 65 interconnected at their proximal ends 66 and 67 (proximal end 67 not shown in FIG. 9, but shown in FIG. 5) with a transom 68. First and second arms 64 and 65 each terminate with a free end 69 and 70, respectively, and are disposed in spaced apart and substantially parallel relation. First and second frameworks 50 and 51 may be constructed of rigid or substantially rigid materials, such as plastic, ceramic or a selected metal, and are each preferably integrally formed.

Free ends 60 and 69 are engagable for pivotal movement, and free ends 61 and 70 are engagable for pivotal movement. Regarding free ends 60 and 69 in the specific example shown in FIG. 9, free end 69 is bifurcated and receives an extension 71 of free end 60. A pin 72 is retained by and passes through the bifurcated portion of free end 69 and through extension 71 for facilitating the pivotal connection. Regarding free ends 61 and 70, free end 70 includes an enlargement 75 that mates with a seat 76 of free end 61. A pin 77 is retained by and passes through seat 76 and through enlargement 75 for facilitating the pivotal connection. Those having regard toward the art will appreciate that other conventional means for facilitating the foregoing pivotal connections may be made without departing from spirit and scope of the invention.

With first and second frameworks 50 and 51 pivotally connected as described above, formed is a continuous rim sized for receipt against the perimeter edge of body 30 of chassis 23. So received by body 30, first and second frameworks 50 and 51 comprising housing are directed for engagement with a surface corner as shown substantially in FIGS. 3–5. With the housing of the invention so seated against body 30 as best shown in FIG. 4, first arms 55 and 64 reside adjacent upper end 31, second arms 56 and 65 reside adjacent lower end 32, transom 59 resides adjacent second lateral extremity 34, transom 68 resides adjacent first lateral extremity 33, and the continuous rim formed with the pivotal joining of first and second frameworks 50 and 51 conforms substantially with the convergent and substantially parallel planes defined by body 30.

Regarding FIG. 9, the housing of trowel assembly 24 supports first and second side cutting blades 80 and 81. Preferably constructed of substantially rigid material such as aluminum or the like, first side cutting blade 80 is engagable and substantially coextensive with transom 59, and second side cutting blade 81 is engagable and substantially coextensive with transom 68. First and second side cutting blades 80 and 81 are carried by the housing in substantially vertical orientation, and may be engaged with their respective transoms 59 and 60 with screws 82, rivets or other suitable fastener as desired by the skilled artisan. So fastened with transoms 59 and 68, first and second side cutting blades 80 and 81 extend outwardly and terminate with cutting edges 80A and 81A (also easily seen in FIG. 4), respectively, each of which is directed for engagement with one of the converging surfaces of a surface corner.

Continuing with FIG. 9, the housing of trowel assembly 24 also supports first and second elongate cutting blades 90 and 91 each in a substantially horizontal orientation. First elongate cutting blade 90 includes a proximal end 92, a distal end 93, a tongue 94 extending along substantially the entire length of first elongate cutting blade 90 from proximal end 92 to distal end 93, and a cutting edge 95 opposing tongue 94. Like first elongate cutting blade 90, second elongate cutting blade 91 includes a proximal end 100, a distal end 101, a tongue 102 extending along substantially the entire length of second elongate cutting blade 91 from proximal end 100 to distal end 101, and a cutting edge 103 opposing tongue 102.

Referring to FIG. 4, first elongate cutting blade 90 is receivable for movement in reciprocal directions along its elongate axis as generally indicated by the double arrowed line A by a channel 110 carried by first arm 64 of second framework 51. Channel 110 extends longitudinally along substantially the entire length of first arm 64 and includes a groove 111 for accommodating tongue 94 for capturing first elongate cutting blade 90 with channel 110. So carried by channel 110, it is preferred that distal end 93 terminate at a point somewhat outboard of proximal end 66 adjacent second side cutting blade 81 and proximal end 92 reside adjacent the free ends 60 and 69 of first arms 55 and 64, respectively. Like first elongate cutting blade 90, second elongate cutting blade 91 is receivable for movement in reciprocal directions along its elongate axis as generally indicated by the double arrowed line B by a channel 112 supported by first arm 55 of first framework 50. Channel 112 extends longitudinally along substantially the entire length of first arm 55 and includes a groove 113 for accommodating tongue 102 for capturing second elongate cutting blade 91 with channel 112. So carried by channel 112, it is preferred that distal end 101 terminate at a point somewhat outboard of proximal end 57 adjacent first side cutting blade 80 and proximal end 100 reside adjacent the free ends 60 and 69 of first arms 55 and 64, respectively. When carried by channels 110 and 112, proximal ends 92 and 100 of first and second elongate cutting blades 90 and 91 converge and are engagable for pivotal movement. In particular, and regarding this specific example, proximal end 92 is bifurcated and receives proximal end 100. A pin 114 is retained by and passes through the bifurcated portion of proximal end 92 of first elongate cutting blade 90 and through proximal end 100 of second elongate cutting blade 91 for facilitating the pivotal connection. Those having regard toward the art will appreciate that other conventional means for facilitating the foregoing pivotal connection may be made without departing from spirit and scope of the invention.

As previously intimated, the housing of the invention, which is comprised of first and second frameworks 50 and 51, is carried or otherwise supported by chassis 23 for pivotal or angular flexing movement along a pivotal axis X, as shown in FIGS. 3 and 4, at free ends 60 and 69 and at free ends 61 and 70 (free ends 61 and 70 not shown in FIGS. 3 and 4). To capture the housing with chassis for this angular flexing movement, and with attention directed to FIGS. 5 and 9, provided is a biasing element comprised of a spring 120 constructed of a selected metal, plastic or other similar material having shape memory. Spring 120 is elongate and includes opposing first and second free ends 121 and 122. Spring 120 is carried adjacent upper end 31 of chassis 23 behind trowel assembly 24. First free end 121 is captured by a bifurcated aspect 123 carried by and extending outwardly from first arm 55, and second free end 122 is captured by a bifurcated aspect 124 carried by and extending outwardly from first arm 64. Spring 120 extends forwardly from its first and second free ends 121 and 122 and traverses against an upstanding element 125 carried by and extending upwardly from upper end 31 of body 30 of chassis 23 behind spring 120. For the purposes of orientation, spring 120 traverses against upstanding element at a location intermediate free ends 121 and 122, and is retained in place by a head 126 of a screw 127 that is threadably receivable into upstanding element 125.

Figure 6:
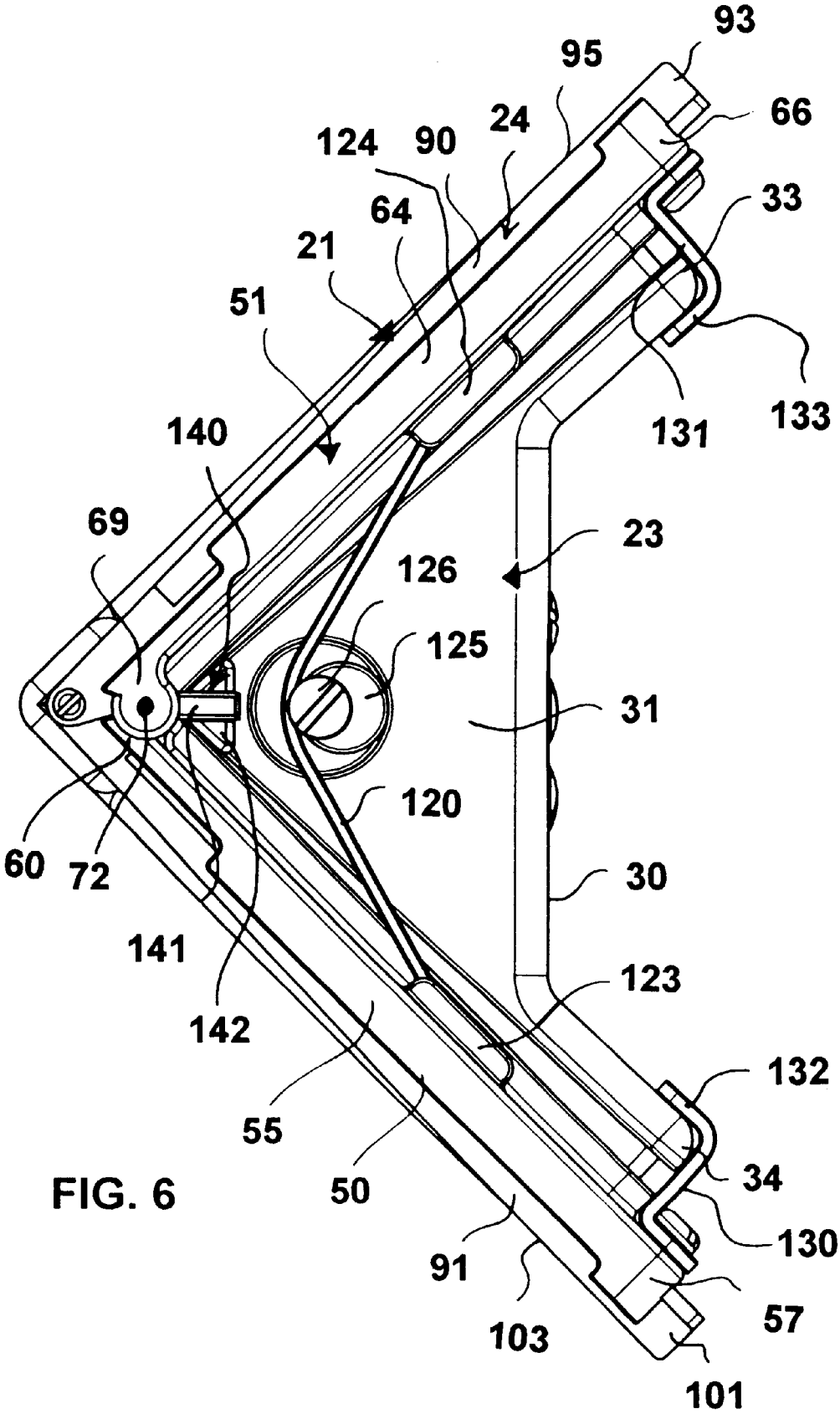
FIG. 6 is a top plan view of the applicator head of FIG. 3 with the housing shown as it would appear in first normal angular orientation.
Figure 7:
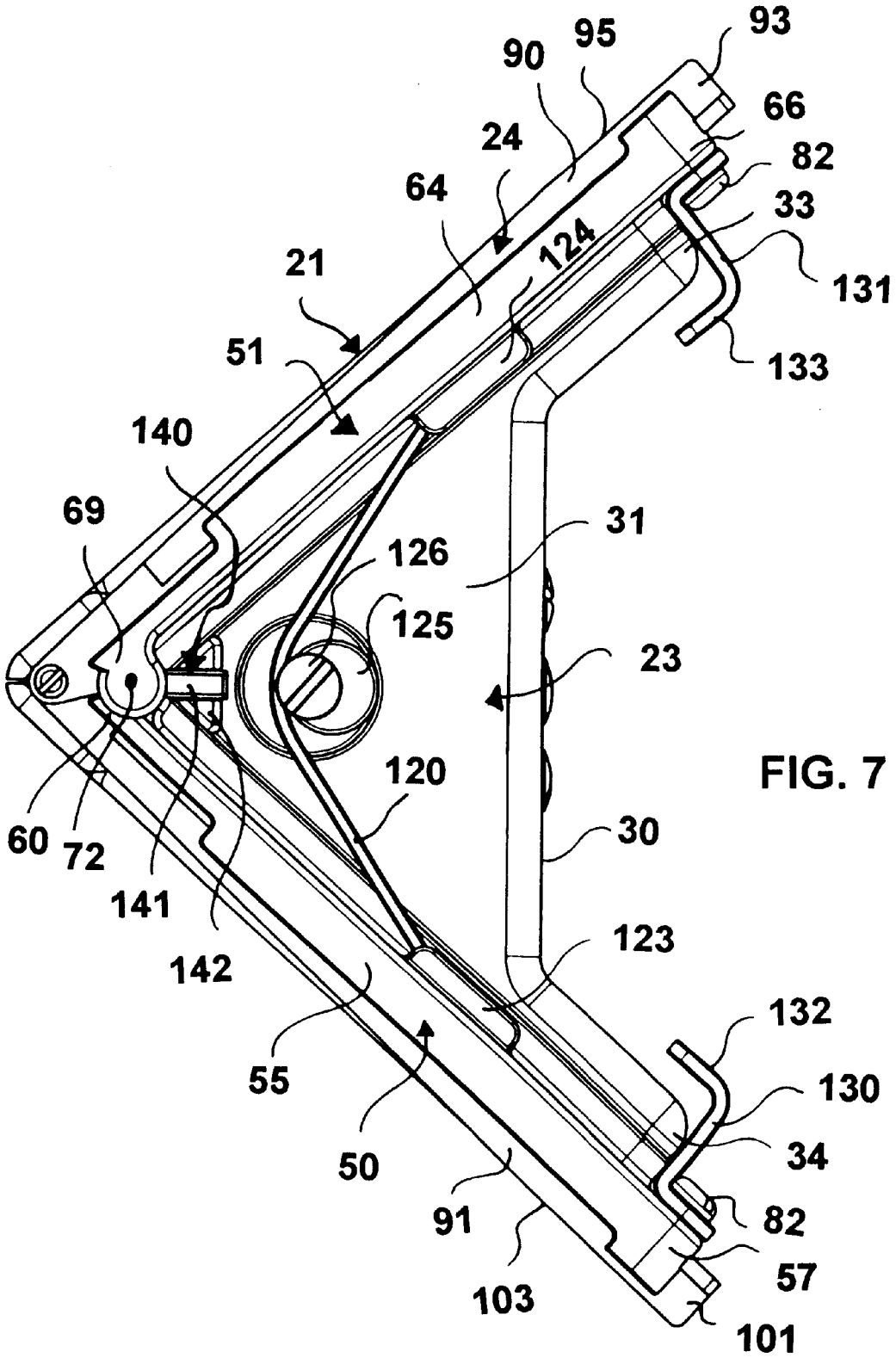
FIG. 7 is a view very similar to the view of FIG. 6 with the housing shown as it would appear in a second angular orientation.

Spring 120 bears against the first arms 55 and 64 of the first and second frameworks 50 and 51 and normally biases the first and second frameworks 50 and 51 outwardly in a normal first angular orientation away or otherwise spaced from body 30, the normal first angular orientation defining a reentrant angle of greater than 90 degrees. The first angular orientation is generally defined by a first stop 130 carried by transom 59 and a second stop 131 carried by transom 68. First and second stops 130 and 131 are fastened with their respective transoms 59 and 68 each with one of screws 82, and extend rearwardly terminating with endwalls 132 and 133 that bear against body 30 of chassis 23 in the normal first angular orientation of the housing of the present invention as best seen in FIG. 6. As a user bears trowel assembly 24 against a surface corner during normal use for distributing mastic or other suitable adhesive-type viscous mass, spring 120 operates to bias the cutting edges of the first and second side cutting blades 80 and 81 and the first and second elongate cutting blades 90 and 91 against the surface corner, and permits first and second frameworks 50 and 51 to flex toward and against chassis 23 about axis X into the second angular orientation defining a reentrant angle of approximately 90 degrees as shown in FIG. 7. Because the first and second side cutting blades 80 and 81 and the first and second elongate cutting blades 90 and 91 bear against the surface corner during use, they operate to doctor or otherwise form the viscous mass against the surface corner for providing smooth, controlled distribution as is customary in this art. This angular flexibility of the housing of the present invention allows trowel assembly 24 to conform easily with surface corners during use. It will be generally understood that the first and second stops 130 and 131 cooperate to capture trowel assembly 24 with chassis 23.

As shown in FIGS. 3 and 4, the first and second elongate cutting blades 90 and 91 pivot at their proximal ends 92 and 100 about a pivotal axis Y spaced from and substantially parallel to pivotal axis X of the first and second frameworks 50 and 51. Pivotal axis Y is spaced apart forwardly of pivotal axis X. As first and second frameworks 50 and 51 pivot about pivotal axis X during movement of the housing between its normal first and second angular orientations, first and second elongate cutting blades 90 and 91 will pivot about pivotal axis Y and, because pivotal axis Y is different from pivotal axis X, will reciprocate in their respective channels 112 and 110. It is important that distal end 93 of first elongate cutting blade 90 terminate somewhat outboard of proximal end 66 of first arm 64, and that distal end 101 of second elongate cutting blade 91 terminate somewhat outboard of proximal end 57 of first arm 55. This is important so that as the first elongate cutting blade 90 reciprocates, it will bear against and maintain continuity with second side cutting blade 81, and that as the second elongate cutting blade 91 reciprocates, it will bear against and maintain continuity with the first side cutting blade 80. Because the first and second elongate cutting blades 90 and 91 are mounted with the housing in this way to maintain continuity with the second and first side cutting blades 81 and 80, respectively, during their reciprocal movement, the elongate and side cutting blades cooperate to engage and form the viscous mass as applicator head 21 is drawn along the surface corner without forming unsightly irregularities or raised edges in the viscous mass at the junction at which the first elongate cutting blade 90 meets the second side cutting blade 81 and the junction at which the second elongate cutting blade 91 meets the first side cutting blade 80.

Because proximal ends 92 and 100 may separate somewhat during pivotal movement, the invention further includes a corner blade 140 mounted adjacent the proximal ends 92 and 100. Looking to FIG. 9, corner cutting blade 140 includes an elongate shaft 141 that rests in a seat 142 carried by body 30 of chassis at upper end 31 just behind free ends 60 and 69 of the first arms 55 and 64 of the first and second frameworks 50 and 51. Shaft 141 extends forwardly from seat 142 terminating with an enlarged head 143 having a pointed cutting blade 144. In this specific example as shown in FIG. 4, enlarged head 143 rests adjacent the proximal ends 92 and 100 of the first and second elongate cutting blades 90 and 91 and, more particularly, intermediate the first and second elongate cutting blades 90 and 91 beneath the proximal ends 92 and 100. Pin 72 passes into enlarged head 143 to hold it in place with the pointed cutting blade 144 directed for engagement with the corner of a surface corner. During use, although first and second elongate cutting blades 90 and 91 pivot and separate somewhat at their proximal ends 92 and 100, corner cutting blade 144 will remain stationary against the corner of the surface corner and, as applicator head 21 is drawn along the corner surface, will cut through the viscous mass forming a sharp corner in the viscous mass.

To permit applicator head 21 to ride smoothly as it is drawn along a surface corner, the invention includes a bearing element 150. Preferably constructed of a high molecular weight polyethylene, bearing element defines two convergent and substantially perpendicular planes and includes a tongue 151 that mates for engagement with groove 152 formed into body 30 of chassis just beneath pocket 44. The physical positioning of the tongue 151 and the groove 152 may be reversed if desired. Tongue 151 is elongate and extends longitudinally. With tongue 151 mated with groove 152, chassis 23 will support bearing element 150 beneath pocket 44 as shown in FIG. 4. So supported, bearing element 150 will bear against the surface corner for permitting smooth movement of applicator head 21 along the surface corner. Because bearing element 150 is removable, it may be replaced when it becomes worn. Like trowel assembly 24, bearing element 150 is angularly flexible with trowel assembly 24.

The present invention has been described above with reference to a preferred embodiment. However, those skilled in the art will recognize that changes and modifications may be made in the described embodiments without departing from the nature and scope of the present invention. Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. Apparatus for applying viscous mass to a surface corner, the apparatus comprising:

a chassis coupled with a source of viscous mass;

a trowel assembly carried by the chassis for receiving viscous mass from the chassis and distributing the viscous mass against a surface corner, the trowel assembly comprising an angularly flexible housing and first and second elongate blades carried by the angularly flexible housing in angularly converging relation for movement in pivotal and reciprocal directions in response to angular flexing of the angularly flexible housing.

2. Apparatus of claim 1, wherein the first and second blades are each mounted for pivotal movement adjacent a flexing point of the angularly flexible housing.

3. Apparatus of claim 1, wherein the first and second blades are each mounted for reciprocal movement in one of a plurality of channels carried by the angularly flexible housing.

4. Apparatus of claim 1, wherein the chassis includes a pocket for collecting viscous mass from the source for distribution to the surface corner.

5. Apparatus of claim 1, wherein the angularly flexible housing is flexibly movable between a first and second angular orientations.

6. Apparatus of claim 5, further including a biasing assembly for normally biasing the angularly flexible housing in one of the first and second angular orientations.

7. Apparatus for applying viscous mass to a surface corner, the apparatus comprising:

a chassis coupled with a source of viscous mass;

a trowel assembly carried by the chassis for receiving viscous mass from the chassis and distributing the viscous mass against a surface corner, the trowel assembly comprising a housing, first and second elongate blades carried by the housing and a corner blade mounted intermediate the first and second elongate cutting blades.

8. Apparatus of claim 7, wherein the housing is angularly flexible.

9. Apparatus of claim 8, wherein the first and second blades are further carried by the housing for movement in pivotal directions in response to angular flexing of the housing.

10. Apparatus of claim 9, wherein the first and second blades are further carried by the housing for movement in reciprocal directions in response to angular flexing of the housing.

11. Apparatus of claim 10, wherein the first and second blades are each mounted for movement in reciprocal directions in one of a plurality of channels carried by the housing.

12. Apparatus of claim 7, wherein the chassis includes a pocket for collecting viscous mass from the source for distribution to the surface corner.

13. Apparatus of claim 8, wherein the housing is flexibly movable between a first and second angular orientations.

14. Apparatus of claim 13, further including a biasing assembly for normally biasing the housing in one of the first and second angular orientations.

15. An applicator head for receiving and applying viscous mass to a surface corner, the apparatus comprising:

a chassis engagable with a source of viscous mass;

a trowel assembly carried by the chassis for receiving viscous mass from the chassis and distributing the viscous mass against a surface corner, the trowel assembly comprising an angularly flexible housing and first and second elongate blades carried by the angularly flexible housing for movement in pivotal and reciprocal directions in response to angular flexing of the angularly flexible housing.

16. The applicator head of claim 15, wherein the first and second blades are each mounted for movement in pivotal directions spaced from a flexing point of the angularly flexible housing.

17. The applicator head of claim 15, wherein the first and second blades are each mounted for movement in reciprocal directions in one of a plurality of channels carried by the angularly flexible housing.

18. The applicator head of claim 15, wherein the chassis includes a pocket for collecting viscous mass from a source for distribution to the surface corner.

19. The applicator head of claim 15, wherein the angularly flexible housing is flexibly movable between first and second angular orientations.

20. The applicator head of claim 19, further including a biasing assembly for normally biasing the angularly flexible housing in one of the first and second angular orientations.

21. Apparatus for applying viscous mass to a surface corner, the apparatus comprising:

a trowel assembly carried by a chassis, the trowel assembly for receiving viscous mass from the chassis and distributing viscous mass against a surface corner; and a bearing element removably carried by the trowel assembly for engagement with the surface corner for permitting smooth movement of the trowel assembly against the surface corner.

22. Apparatus of claim 21, wherein the bearing element defines two convergent and substantially perpendicular planes.

23. Apparatus of claim 21, further including:

a tongue carried by one of the bearing element and the chassis; and a groove carried by the other one of the bearing element and the chassis for detachable engagement with the tongue.

24. Apparatus of claim 21, wherein the bearing element is angularly flexible.

25. Apparatus of claim 21, wherein the trowel assembly comprises an angularly flexible housing and first and second elongate blades carried by the angularly flexible housing in angularly converging relation for movement in pivotal and reciprocal directions in response to angular flexing of the angularly flexible housing.

26. Apparatus of claim 21, wherein the first and second blades are each mounted for pivotal movement adjacent a flexing point of the angularly flexible housing.

27. Apparatus of claim 21, wherein the first and second blades are each mounted for reciprocal movement in one of a plurality of channels carried by the angularly flexible housing.

28. Apparatus of claim 21, wherein the chassis includes a pocket for collecting viscous mass from the source for distribution to the surface corner.

29. Apparatus of claim 21, wherein the angularly flexible housing is flexibly movable between a first and second angular orientations.

30. Apparatus of claim 29, further including a biasing assembly for normally biasing the angularly flexible housing in one of the first and second angular orientations.

* * * * *